United States Patent [19]

Hatz et al.

[11] 4,293,092

[45] Oct. 6, 1981

[54] HEATING SYSTEM WITH HEAT PUMP AND AUXILIARY HEATER

[75] Inventors: Ernst Hatz; Heinz Eibl, both of Ruhstorf; Erwin Peter, Wendlingen; Rolf Blumhardt, Wernau, all of Fed. Rep. of Germany

[73] Assignee: Motorenfabrik Hatz GmbH & Co. KG, Ruhstorf, Fed. Rep. of Germany

[21] Appl. No.: 54,913

[22] Filed: Jul. 5, 1979

[30] Foreign Application Priority Data

Aug. 25, 1978 [DE] Fed. Rep. of Germany ..... 2837248

[51] Int. Cl.[3] ..... B60H 1/02; F24C 9/00

[52] U.S. Cl. ..... 237/12.1; 237/2 B; 237/1 R; 126/247; 122/26; 62/238.6

[58] Field of Search ..... 237/2 B, 12.1, 1 R; 126/247; 122/26; 62/238 E; 60/648

[56] References Cited

U.S. PATENT DOCUMENTS 3,771,593 11/1973 Shepheard ..... 126/247

3,858,802 1/1975 Stobart ..... 237/12.1

FOREIGN PATENT DOCUMENTS 153491 10/1953 Australia ..... 122/26

*Primary Examiner*—Albert J. Makay

*Assistant Examiner*—Henry Bennett

*Attorney, Agent, or Firm*—Blanchard, Flynn, Thiel, Boutell & Tanis

[57] ABSTRACT

A heating system for a building utilizing a heat pump having a condenser which is driven by an internal combustion engine. The internal combustion engine drives an additional aggregate, such as a brake, for the purpose of generating additional heat which is added to the main heat carrier in the heating network in the building. The circulating system for the additional heat generating aggregate is self-contained and separate from the heating network of the building.

6 Claims, 1 Drawing Figure

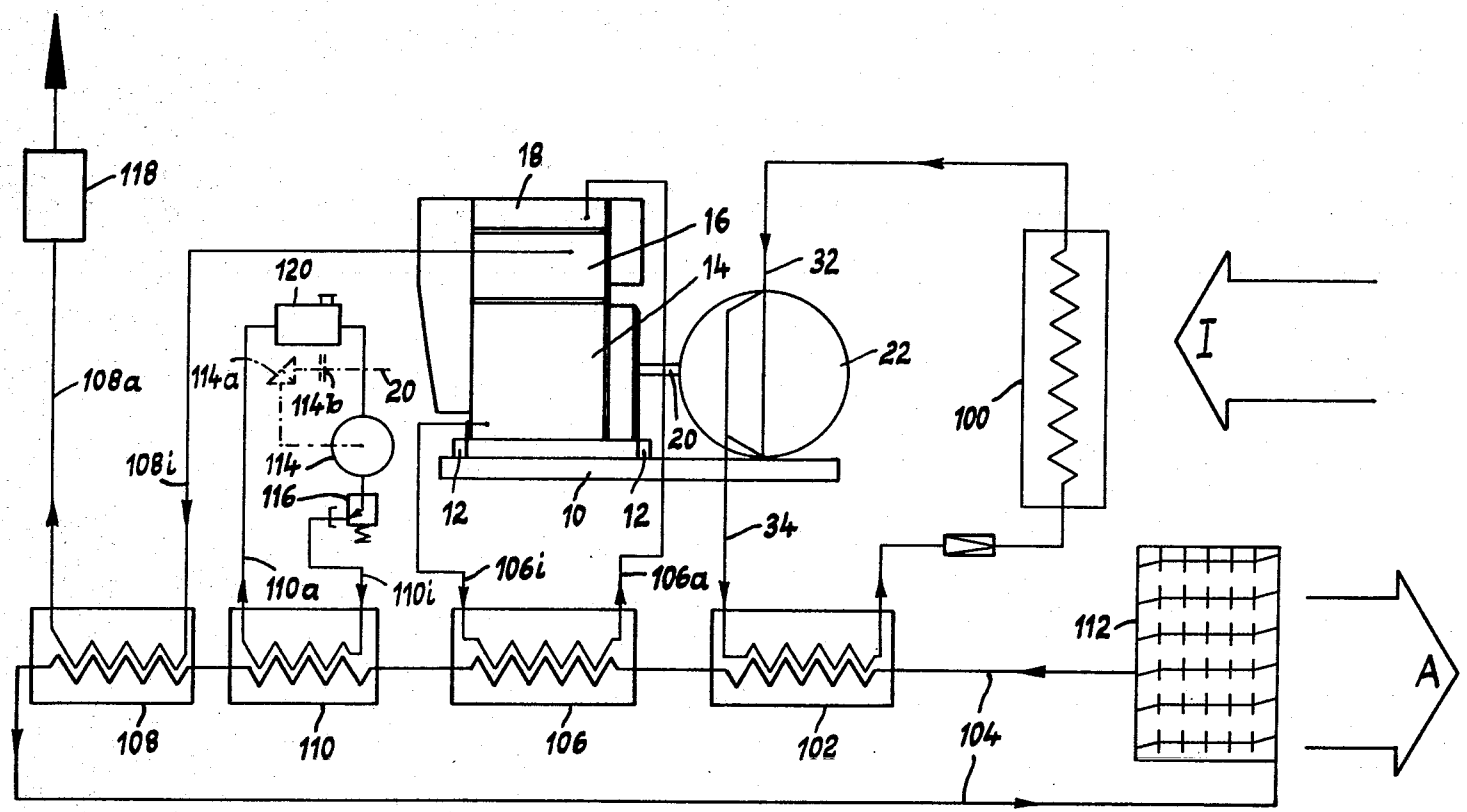
A
I
112
100
104
22
32
34
102
16
14
20
106a
12
10
106
18
106i
12
20
110i
120
114b
114
116
110a
110
114a
108i
108
118
108a

HEATING SYSTEM WITH HEAT PUMP AND AUXILIARY HEATER

FIELD OF THE INVENTION

The invention relates to a heat pump having a compressor driven by an internal combustion engine, for the cooling medium in its cycle, which receives the heat from a surrounding medium and feeds it to a heating system, for example a house heating system.

BACKGROUND OF THE INVENTION

A so-called heat pump is an aggregate for a heat-circulating process of such a type that a liquid cooling fluid is evaporated in an evaporator at +2° C. and thereby receives the heat from a fluid, which surrounds the evaporator, for example water or air, at a temperature of +10° C. The cooling fluid gas of +2° C. absorbs here approximately 10kW heat power and is then drawn away by a compressor. The cooling fluid gas is condensed to 15.5 bar in said compressor, is heated up to +60° C. and by receiving further 5kW (compressor output) is fed to a condenser. Here the cooling fluid gas releases again at an unchanged high pressure the absorbed 15kW and becomes a liquid. The heating water for, for example, a house heating system of the conventional type is conducted through the condenser and absorbs the heat which is released by the cooling fluid gas, which is now in the heating water fed to the actual heating unit.

The liquid cooling fluid at +60° C. moves from the condenser on to an expansion valve, expands, and assumes a lower pressure of 3.5 bar at a temperature of +2° C. This cooling fluid is returned for evaporation and a new cycle of this fluid in the heat pump starts again. (The aforementioned values are only exemplary information, which will aid in making the cycle of the heat pump easily understandable. The physical bases of a heat pump are discussed in detail for example in "VDI-Statusbericht Wärmepumpe" VDI-Verlag GmbH, Düsseoldorf 1976.)

The quantity of heat of such systems depends largely from the seasonal temperature of the surrounding medium, from which the heat is taken for heating purposes. One therefore calculates the desired performance of a system based on the surrounding temperature which occurs most often during the year (0° to +15° C.). During cold times of the year, however, often temperatures which lie below the above temperatures will occur in the area (−15° to 0° C.), so that the calculated performance cannot be reached. The reason for this lies in the cooling fluid having at low temperatures a low gas pressure and thus a lower specific weight. (One would need a higher volume, namely volume variation in the compressor, to compensate for this, which, however, is not economically acceptable.) Conventional heat pumps have namely only constant compressor volumes, so that at low outside temperatures, the compressor does not utilize the available full power of the internal combustion engine which drives it. Thus the engine runs mostly in the partial-load condition and gives off only small amounts of heat into its cooling water, lubricating oil and exhaust gas. In this manner, larger amounts of heat are not utilized, which the internal combustion engine would be capable of delivering at a higher load.

It is therefore known to supply in addition to the actual heat source (for example surrounding air) a further heat source to the heat pump, such as an auxiliary heater in the form of a common heating system (for example oil heat). Such heating systems (two-condition heating systems), however, are economically not feasible.

The purpose of the present invention is to overcome the disadvantages of the two-condition heating systems, to sensibly utilize the power reserves of the internal combustion engine at any time of the year and to feed same to the heating system. This purpose is inventively attained by the internal combustion engine driving a special energy-transforming aggregate (for example friction brake or hydraulic brake), which is arranged in a circulating system which is self-contained and is separate from the heating network of the system, and which transforms the mechanical drive power which is fed to it during the operation into heat power, which is transmitted as additional heat onto the heat carrier in the heating network.

One simple embodiment of the invention results in the hydraulic brake being arranged in a hydraulic circulating system which is separate from the main heating network, is self-contained and includes a heat exchanger which transmits the additional heat into the heat carrier in the main heating network.

As a hydraulic fluid, either water or hydraulic oil can be selectively used. The hydraulic brake is then designed depending on the type of fluid used for example as a hydraulic brake or a hydraulic pump.

It is preferable in each of the mentioned embodiments to place a regulating valve between the hydraulic brake and the associated heat exchanger, which regulating valve controls the hydraulic circulation in relationship to the speed of the internal combustion engine or from a different parameter (for example surrounding temperature).

BRIEF DESCRIPTION OF THE DRAWING

One exemplary embodiment of the invention will be discussed in more detail in the following description with reference to a drawing.

DETAILED DESCRIPTION

The heat pump which is only schematically illustrated in the drawing includes a water-cooled fuel-injection internal combustion engine of a conventional type, which serves to drive the compressor, namely the condenser for the cooling medium during the cycle of the heat pump. Such a compressor-machine-unit is illustrated and described for example in German OS No. 28 14 728 in all details, so that it will not be discussed in more detail here. The crank housing 14, the cylinder housing 16 and the cylinder heads 18 of the machine are fastened on a base plate 10 by means of some intermediate elements 12. The crankshaft 20 of the internal combustion engine drives the compressor 22, which is also secured to the plate 12. The inlet pipe of the compressor 22 is identified by the reference numeral 32 and its compressed cooling medium outlet pipe is identified by the reference numeral 34. The evaporator 100 mentioned above absorbs the heat from the medium, for example air, which surrounds the evaporator, as is indicated with the arrow I. During its compression phase, the cooling fluid gas is condensed and is then fed through the pipe 34 to a condenser 102 which functions as a heat exchanger, through which condenser flows heating water in a separate pipe 104. The heating water is warmed up in the pipe 104 in the heat exchanger 102.

The pipe 104 subsequently extends through further heat exchangers 106, 108, 110, before it is fed to a house heating system 112, where its water again radiates the accumulated heat for the purpose of heating, as is indicated by the arrow A.

The cooling water of the internal combustion engine, which water is substantially heated up during the operating cycle, is conducted by means of pipes **106*i* and 106*a* through an additional heat exchanger 106**.

Also the exhaust gases of the internal combustion engine are conducted in an exhaust pipe **108*i* to an associated heat exchanger 108. The exhaust gases here release their heat and are then conducted in a pipe 108*a* to an exhaust-sound absorber 118** and finally to the atmosphere.

The transfer of the heat from the cooling water and the exhaust gases into the heating system, which transfer occurred with the aid of the additional heat exchangers 106 and 108 is actually known. However, such a heating method is not sufficient for the reasons which will be discussed in more detail hereinbelow, in order to assure a sufficient heating up of the heating water also in the case of low outside temperatures, for example below 0° C.

It is known that the need for heat in houses increases with low outside temperatures. The heat generating capability of the heat pump cooling fluid, however, does not increase to the degree which is necessary for low temperatures in spite of the increase of the speed of the machine which drives the compressor. As has already been mentioned above, the reason for this is that the cooling fluid has at low temperatures a low gas pressure and thus a lower specific weight. (One would need for the compensation a higher volume, namely volume variation in the compressor, which, however, economically is not feasible). Conventional heat pumps have namely only constant compressor volumes, so that during the lower temperature periods of the year the compressor does not absorb the available full output of the internal combustion engine, which drives said compressor. Thus the engine runs mostly in the partial-load region and gives off only small amounts of heat into its cooling water, lubricating oil and exhaust gas. Larger amounts of heat are in this manner not utilized, which the internal combustion engine would be capable of delivering at a higher load.

This basic disadvantage of known heat-pump heating systems of the conventional type is now inventively overcome by the internal combustion engine driving aside from the common devices also a hydraulic brake, which is arranged in a closed circulating system which is separate from the heating network of the system, wherein the heat of the hydraulic fluid is fed to the heating system after flowing through the brake. The output of the drive engine is in this manner fully utilized and thus delivers maximum amounts of heat into its cooling water, exhaust gas and lubricating oil.

A still further heat exchanger 110 is provided for this purpose in the pipe 104 in the exemplary embodiment, through which heat exchanger is conducted the hydraulic fluid, for example water or hydraulic oil. This fluid is conveyed by a hydraulic pump 114 which serves as a brake and which is driven through a gearing **114*a* and a clutch 114*b* by the crankshaft 20 of the internal combustion engine, and which pump draws the hydraulic fluid from a larger container 120 and conveys it through a regulating member 116 into the supply pipe 110*i* of the heat exchanger 110. The hydraulic pump 114 can be designed as a geared pump and the regulating member 116 controls in the illustrated case the pressure of the hydraulic fluid in relation to the outside temperature. The regulating member 116 is constructed as a valve, which itself is influenced by a thermostat of conventional type, which lies in the heating pipe 104**.

The clutch **114*b*** could be example be releasable manually, in order to be able to switch the hydraulic circulation on only if needed.

It makes sense that the aggregate 114, which transforms the energy and delivers the additional heat for the heat carrier in the heating network 104, together with the regulating member 116 can be inserted also in such systems, which do not have a transfer of the heat due to energy losses of the internal combustion engine onto the heat carrier in the heating network, thus do not have any heat exchangers 106 and 108.

In conclusion, it is mentioned that depending on the need, the hydraulic brake can also be short-circuited. Moreover, it would be possible—in contrast to the described exemplary embodiment with the arrangement of the hydraulic brake 114 and its circulating system outside of the internal combustion engine—to integrate the brake 114 with the associated section of the pipe 104 also in the machine. Finally, it would be possible in each one of the discussed cases of use to regulate the hydraulic brake based on a different parameter (for example from the speed of the internal combustion engine) instead of a relationship to the outside temperature.

The arrangement of an auxiliary circulating system which is closed in itself and is separate from the main heating network of the system brings special advantages. First of all, the vibrations or pulsations of the fluid in the auxiliary circulating system, which includes the friction brake, cannot be transmitted onto the heat carrier in the main network of the heat pump itself and cannot cause undesired noises, which could be transmitted in the home heating systems into the living rooms of the house and could result in the production of loud noises of substantial intensity. Therefore, the location for storing the auxiliary aggregate or the fluid brake and its circulating system can be freely changed. Furthermore, when a separate circulating system is used for the friction brake, a specially easy and simple regulating device for controlling its cycle can be provided.

Finally it is pointed out that different heating fluids can be used for the main heating network and the auxiliary network, and that in place of a hydraulic fluid (water, hydraulic oil or the like) for the circulating system of the friction brake, it is also possible to use a gaseous fluid, for example air.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heating system comprising a main heating network including a heat carrier and an internal combustion engine and a heat pump having a condenser, said condenser of said heat pump being driven by the internal combustion engine for supplying heat to said heat carrier of said main heating network, said internal combustion engine also driving an additional aggregate which transforms the mechanical drive power fed to it by the engine into heating power and transmits such heating power as additional heat to the heat carrier of said main heating network, the improvement comprising a circulating system which is self-contained and is separate from said main heating network, which circulating system incorporates said additional aggregate, said circulating system further incorporating a heat exchanger for transmitting the heat provided by the additional aggregate by way of a fluid which circulates in said circulating system to said heat carrier in said main heating network, means for scavenging heat energy from the coolant and exhaust gas of said internal combustion engine and supplying said heat to said main heating network, said additional aggregate being a fluid brake, said brake being mechanically driven by said internal combustion engine for operation at a speed proportional thereto, said separate self-contained circulating system including a regulating member associated with said fluid brake, said regulating member being a valve responsive to the surrounding temperature and hence to the heat required to be supplied by the main heating network, there being a relatively low surrounding temperature below which heat pump gas pressure and gas specific weight and therefore heat pump efficiency fall below a preselected limit and accordingly reduce loading of the engine to below a preselected limit, said regulating member being arranged for actuating said fluid brake at said relatively low temperature for thereby increasing the heat fed to said main heating network, by adding heat to said main heating network from said fluid brake and its separate circulating system, and also by increasing the amount of heat added to said main heating network from the exhaust gas and coolant of said engine due to increased engine loading.

2. The system according to claim 1, wherein the fluid brake of said additional aggregate is a hydraulic brake and the fluid which circulates in said circulating system is water.

3. The system according to claim 1 wherein said brake is couple synchronously with said internal combustion engine.

4. The system according to claim 1, wherein said additional aggregate has its heat output compensated for the drop in power of the heat pump due to outside temperatures lower than the normal operating range of such heat pump.

5. The system according to claim 1, wherein said additional aggregate has a heat output which overcompensates during lower outside temperatures for the then-occurring power drop of the heat pump.

6. The system according to claim 1, wherein said fluid which circulates in the circulating system is hydraulic oil and said brake is a hydraulic pump.

* * * * *